US006712360B2

(12) United States Patent
Yaple

(10) Patent No.: US 6,712,360 B2
(45) Date of Patent: Mar. 30, 2004

(54) CASINO CARD GAME

(76) Inventor: Robert Terry Yaple, 10100 Baymeadows Rd., #1002, Jacksonville, FL (US) 32256

( * ) Notice: Subject to any disclaimer, the term of this patent is extended or adjusted under 35 U.S.C. 154(b) by 0 days.

(21) Appl. No.: 10/206,429

(22) Filed: Jul. 26, 2002

(65) Prior Publication Data

US 2003/0020238 A1 Jan. 30, 2003

Related U.S. Application Data

(60) Provisional application No. 60/308,284, filed on Jul. 27, 2001.

(51) Int. Cl.[7] ..... A63F 1/00

(52) U.S. Cl. ..... 273/292; 273/274; 273/146; 273/309; 273/268

(58) Field of Search ..... 273/292, 274, 273/146, 138 R, 309

(56) References Cited

U.S. PATENT DOCUMENTS

| | | | | | |
|---|---|---|---|---|---|
| 2,560,187 | A | * | 7/1951 | Post | 273/146 |
| 3,614,105 | A | * | 10/1971 | Dandini | 273/146 |
| 5,067,724 | A | * | 11/1991 | Rinkavage | 273/292 |
| 5,125,660 | A | * | 6/1992 | Stahl | 273/146 |
| 5,558,328 | A | * | 9/1996 | Krantz | 273/146 |
| 5,607,161 | A | * | 3/1997 | Skratulia | 273/292 |
| 5,690,335 | A | * | 11/1997 | Skratulia | 273/292 |
| 5,997,000 | A | * | 12/1999 | Nakano et al. | 273/274 |
| 6,257,579 | B1 | * | 7/2001 | Horan | 273/274 |
| 6,332,614 | B1 | * | 12/2001 | Hesse | 273/292 |
| 6,334,613 | B1 | * | 1/2002 | Yoseloff | 273/292 |
| 6,371,484 | B1 | * | 4/2002 | Yuan | 273/292 |
| 6,378,869 | B1 | * | 4/2002 | Hedge et al. | 273/274 |
| 6,386,973 | B1 | * | 5/2002 | Yoseloff | 463/13 |
| 6,428,005 | B2 | * | 8/2002 | Au-Yeung | 273/274 |
| 6,446,972 | B1 | * | 9/2002 | Brunelle | 273/292 |
| 6,457,714 | B1 | * | 10/2002 | Feola | 273/274 |
| 6,474,644 | B1 | * | 11/2002 | Pickle et al. | 273/274 |
| 6,481,717 | B1 | * | 11/2002 | Richardelle | 273/292 |
| 6,485,020 | B1 | * | 11/2002 | Broadnax | 273/292 |
| 6,494,454 | B2 | * | 12/2002 | Adams | 273/292 |
| 6,508,469 | B2 | * | 1/2003 | Promutico | 273/274 |
| 6,517,072 | B1 | * | 2/2003 | McInerney | 273/236 |
| 6,565,088 | B2 | * | 5/2003 | Perrie et al. | 273/146 |
| 6,568,677 | B2 | * | 5/2003 | Brenner | 273/144 B |
| 6,575,464 | B1 | * | 6/2003 | Fertitta et al. | 273/274 |
| 6,575,465 | B2 | * | 6/2003 | Lo | 273/292 |
| 6,581,936 | B1 | * | 6/2003 | Zoccolillo et al. | 273/274 |

OTHER PUBLICATIONS

Perrie et al.__Pub. No.: US 2002/0163127 A1—Poker Dice Casino Game Method of Play—Nov. 7, 2002.*

Breedings et al.—Pub. No.: US 2003/0075869 A1—Bet Withdrawal Casino Game With Wild Symbol—Apr. 24, 2003.*

Au–Yeung—Pub. No.: US 2001/0048196 A1—Poker Game—Dec. 6, 2001.*

Braun—Pub. No.: US 2002/0190467 A1—Poker Game Assembly and Method of Card Playing in a Casino—Dec. 19, 2002.*

Yuong et al.—Pub. No.: US 2003/0013510 A1—Casino Card Game—Jan. 16, 2003.*

Flannery—Pub. No.: US 2001/0030393 A1—Casino Game—Oct. 18, 2001.*

Huad et al.—pub. No.: US 2003/0071415 A1—Method and System for Playing a Casino Game—Apr. 17, 2003.*

* cited by examiner

*Primary Examiner*—Benjamin H. Layno
*Assistant Examiner*—Dolores R Collins
(74) *Attorney, Agent, or Firm*—Thomas C. Saitta

(57) ABSTRACT

A method of playing a poker game using a standard deck of cards, a first die having indicia representative of Jokers and numbers, a second die having indicia representative of numbers, and Joker icons, wherein the number of cards and Joker icons from which a player builds the best possible five card poker hand is determined by rolling the dice.

19 Claims, 3 Drawing Sheets

CASINO CARD GAME

This application claims the benefit of U.S. Provisional Patent Application Serial No. 60/308,284, filed Jul. 27, 2001.

BACKGROUND OF THE INVENTION

The invention relates to a game apparatus or kit and method of playing a casino style card game relating to a combination of stud poker, dice and betting. The invention further relates to such an apparatus or kit and method where players play against the dealer representing the house or casino. The invention utilizes a standard 52 card deck of playing cards, Joker icon tiles and a pair of dice having Jokers and numbers on their faces in different combinations.

SUMMARY OF THE INVENTION

The game apparatus or kit of the invention comprises a standard 52 card deck of playing cards, a first six-sided die having designations or indicia for combinations of Jokers and numbers of cards, to wit, the indicia Joker, Joker, Joker, one, two and a pair of "D"s, one indicia per side, a second six-sided die having designations or indicia for numbers of cards, to wit, the indicia four, four, three, two, two and two, again one indicia per side, and a plural number of Joker tiles or icons.

The method of play and the rules of the game encompass a player placing an ante bet and rolling the dice. The indicia on the dice indicate the number of cards and possibly a Joker icon that the player will receive from the dealer. The dealer begins with a Joker icon and three cards. A player stays in the game by placing another bet, after which he receives another two cards. The player can raise the bet, fold or stay pat. The dealer receives two more cards. The dealer and the player each build the best possible five card poker hand from the cards and Jokers they possess, if any, with the Joker being a wild card. If the player's hand is better than the dealer's hand under the standard Poker hierarchy, he wins, and if not, he loses. Multiple players may play against the dealer at one time, with the dealer's hand being used against each player's hand.

DETAILED DESCRIPTION OF THE INVENTION

With reference to the figures, the invention will now be described in detail with regard for the best mode and the preferred embodiment.

In general, the invention is a game apparatus and a method of playing a game with the apparatus, where the apparatus comprises playing cards, dice and representational icons, where the method includes random card combinations, dice rolls and betting against a dealer representing the house or casino.

Figure 3:
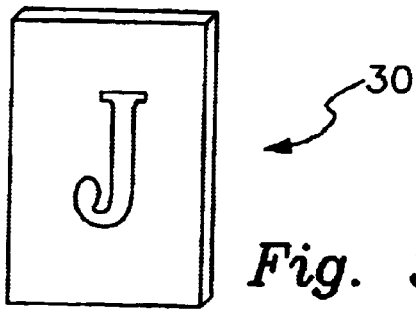
FIG. 3 is an illustration of a Joker icon.

A standard deck of 52 playing cards having four suits of cards numbered from two through 10 and face cards of Jack, Queen, King and Ace is used. Relatively small tiles, chips or other physical icons 30 are used to represent Jokers, with the Joker icons 30 acting as wild cards such that the possessor may designate a Joker icon 30 to represent any playing card desired. Preferably the Joker icon 30 is relatively similar in size and shape to a playing card, as shown for example in FIG. 3.

Figure 1:
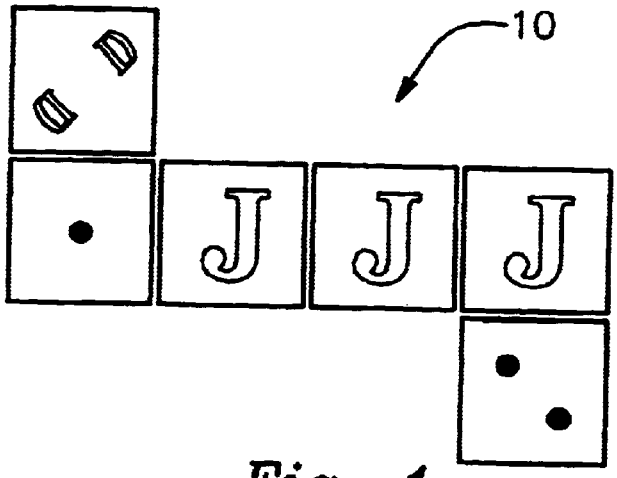
FIG. 1 is an exploded view of one of the dice.

A pair of six-sided dice 10 and 20 is utilized. The first die 10, as shown in FIG. 1, has indicia on each side representing either a Joker, the number one, the number two, or a pair of "D"s. This is accomplished for example by using a "J" to represent a Joker, by using a single dot or the numeral to represent the number one, using a pair of dots or the numeral to represent the number two, and using a pair of "D"s or similar indicia to simultaneously represent the number two and a double down betting option. Most preferably, the Joker indicia is placed on three of the sides of the first die 10, the indicia for the number one is placed on one of the sides of the first die 10, the indicia for the number two is placed on one of the sides of the first die 10, and the pair of "D"s is placed on the remaining side of the first die 10. Thus on a given roll of this first die 10, the player has a ⅗ chance to roll a Joker, a ⅙ chance to roll a one, a ⅙ chance to roll a two, and a ⅙ chance to roll a two with the double down betting option.

Figure 2:
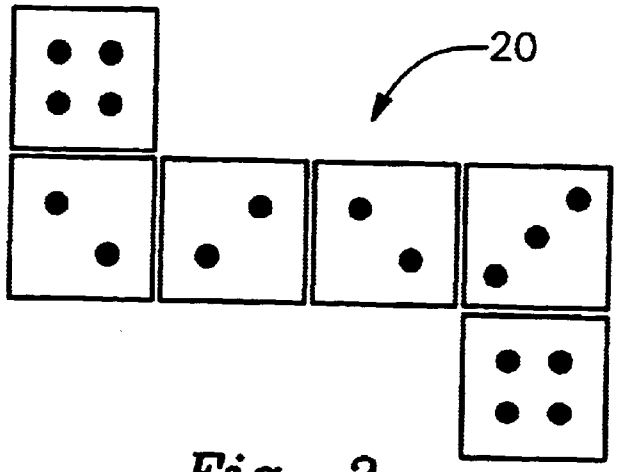
FIG. 2 is an exploded view of the second of the dice.

The second die 20, as shown in FIG. 2, has indicia on each side representing the numbers two, three and four, which may be represented by the corresponding number of dots or the numeral itself. The indicia for the number two appears on three sides of the second die 20, the indicia for the number three appears on one side of the second die 20, and the indicia for the number four appears on two sides of the second die 20. Thus on a given roll, the player has a ⅗ chance to roll a two, a ⅙ chance to roll a three, and a ⅔ chance to roll a four with the second die 20.

The Joker indicia on the die 10 represents the Joker icon as a wild card, while each numeral indicia represents a corresponding number of playing cards to be received from the dealer.

Figure 4:
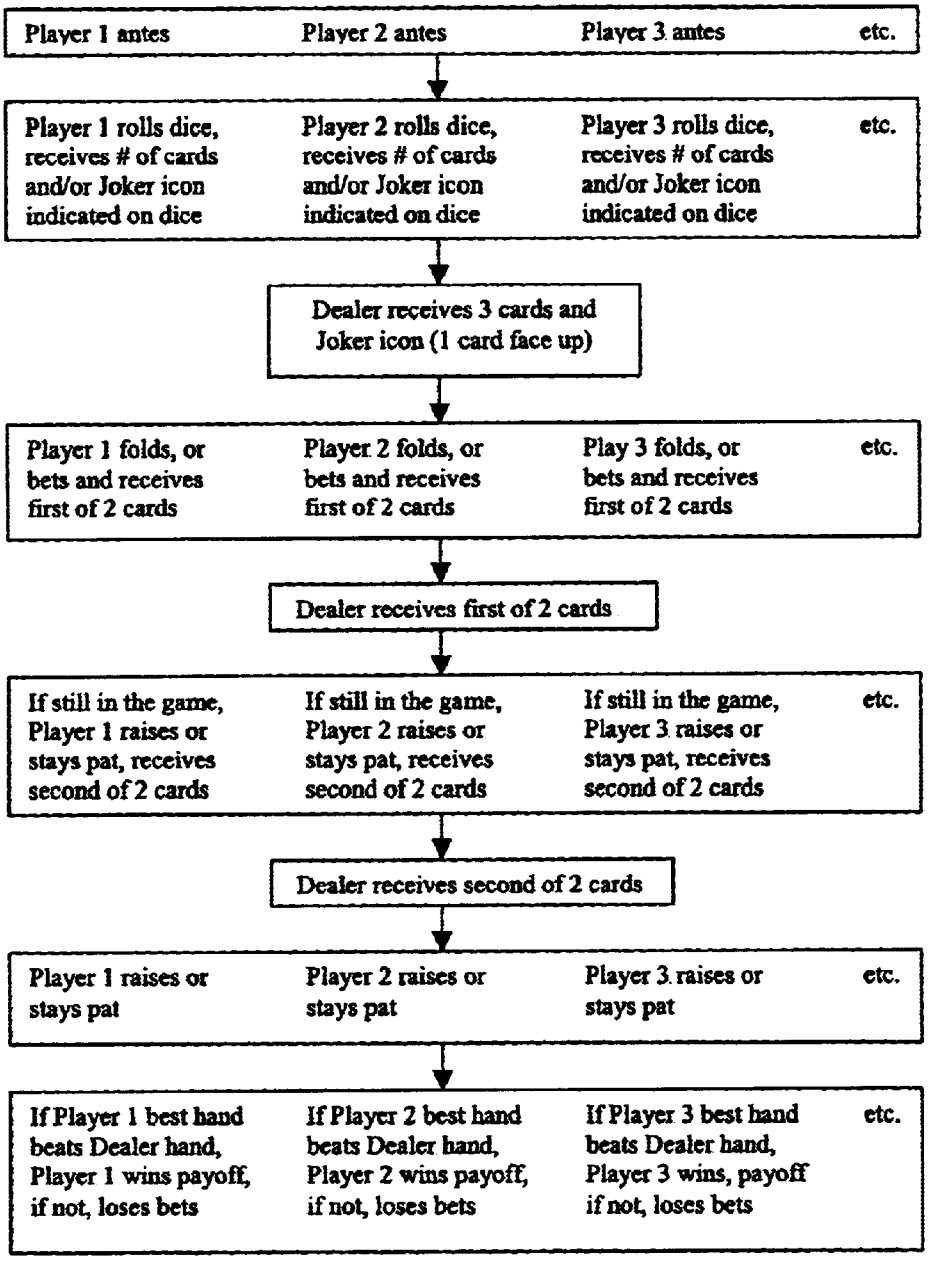
FIG. 4 is a flow diagram showing the method of play.
Figure 5:
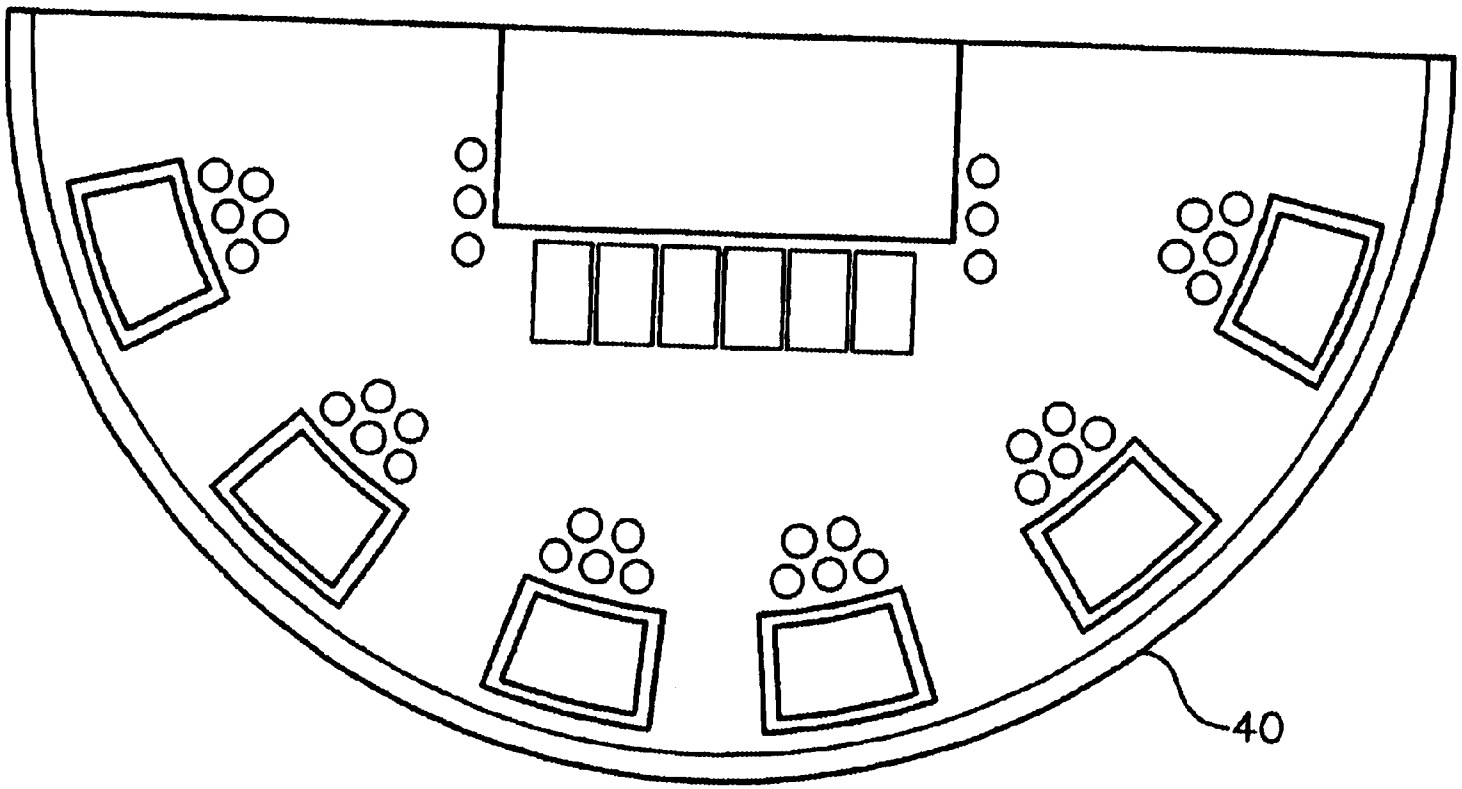
FIG. 5 is an illustration of a playing table for the game.

One or more players simultaneously play against a dealer who represents the house or casino, with the players playing and receiving cards in order throughout the game. The game methodology is shown in FIG. 4. To begin the game, each player places an ante bet, which amount is determined by the casino. The first player then rolls the dice 10 and 20 to determine his starting hand. The player will either roll a pair of numbers, a number and the pair of "D"s representing the number two, or a number and a Joker indicia. The dealer then deals the total number of cards to the player face down which equal the total of the numbers exposed on the dice 10 and 20. If a Joker indicia is rolled, the dealer gives the player a Joker icon 30 to represent a wild card, i.e., the player can choose to have the Joker icon 30 represent any card desired. If a pair of "D"s are rolled, the player will receives two cards and has the option to double the initial ante if the hand is felt to be strong.

Table I illustrates the possible player hands resulting from the various roll combinations.

TABLE I

| Possible card/J hands after rolling the dice | Added cards after betting | | Possible card/J combination totals to build 5 card poker hand from |
|---|---|---|---|
| (1 card + 2 cards) | + 2 cards | = | 5 cards |
| (1 card + 3 cards) | + 2 cards | = | 6 cards |
| (1 card + 4 cards) | + 2 cards | = | 7 cards |

TABLE I-continued

| Possible card/J hands after rolling the dice | Added cards after betting | | Possible card/J combination totals to build 5 card poker hand from |
|---|---|---|---|
| (2 cards + 2 cards) | + 2 cards | = | 6 cards |
| (2 cards + 3 cards) | + 2 cards | = | 7 cards |
| (2 cards + 4 cards) | + 2 cards | = | 8 cards |
| (J icon + 2 cards) | + 2 cards | = | J icon + 4 cards |
| (J icon + 3 cards) | + 2 cards | = | J icon + 5 cards |
| (J icon + 4 cards) | + 2 cards | = | J icon + 6 cards |

The second player then rolls the dice 10 and 20 in turn and receives cards and possibly a Joker icon 30, the third player rolls the dice 10 and 20 in turn and receives cards and possibly a Joker icon 30, etc., until all players have received their start hands. In this manner a start hand may consist of either six cards, five cards, four cards, four cards plus a Joker icon 30, three cards plus a Joker icon 30, or two cards plus a Joker icon 30.

The dealer then deals himself three playing cards, with the first card exposed face up to the players. The dealer also receives a Joker icon 30.

Each player now determines whether to stay in the game or fold, based on factors such as the number and the value of the cards received in the start hand, whether a Joker icon 30 was received, and knowledge of the dealer's exposed card. To stay in the game each of the multiple players must place a bet, in which case the player will receive two more cards face up from the dealer. The dealer deals a single first card face up to each of the multiple players and to the dealer. The first player then decides whether to raise the bet or stay pat, with the decision being based on the best possible five card poker hand which can be constructed from the cards and Joker icons in the possession of the first player, plus the knowledge that one more card will be received. The first player also has the advantage of knowing the face up cards in front of the other players and the dealer. The second, third, etc., players make the same decisions as the first player in turn.

The dealer now deals a second card face up to each of the multiple players and to the dealer. The first player then decides whether to make a second raise bet or stay pat, with the decision being based on the best possible five card poker hand now being based on the best possible five card poker hand which can be constructed from the cards and any Joker icons 30 in the player's possession, with the Joker icons 30 representing any card desired, plus the knowledge of the face up cards in front of the other players and the dealer. The first player will now have a hand consisting of the either eight cards, seven cards, six cards, six cards plus a Joker icon 30, five cards plus a Joker icon 30, or four cards plus a Joker icon 30. The second, third, etc., players make the same decisions as the first player in turn.

The dealer then exposes all the dealer's cards to the players, such that the dealer's best possible five card poker hand is known to all. Each player's best possible five card poker hand is then compared to the dealer's best possible five card poker hand. If the player's hand is better, the player wins a payoff. If the dealer's hand is better, the player loses his bets. All cards and Joker icons 30 are retrieved, the cards are shuffled, and another round begins.

It is possible to vary the number of Joker indicia appearing on the die 10 as well as the particular numerals and their frequency appearing on the dice 10 and 20. Such changes will affect the wining percentage associated with the game, as such changes will increase or decrease the likelihood of receiving the maximum number of cards from which to build a hand, and will increase or decrease the likelihood of receiving a Joker icon 30.

A representative playing table or cover 40 is shown which may be utilized in a casino setting. The semi-circular layout is shown with six player positions, each position having an ante circle, a betting circle and a raise circle in front of a generally rectangular designated card area, within which all cards must be kept during play. Other circles may be provided for jackpot and raise bets. A no card area is placed on the perimeter. Rectangles may be provided adjacent each card area for placement of a Joker icon 30. The dealer position is shown as a large rectangle having rectangles to receive the dealer's cards and Joker icon 30, as well as jackpot circles.

As an optional method of playing the game, the players may play the jackpot as an additional side bet, with a jackpot board of winning hands maintained by the casino. Players put a chip in the jackpot circle at the beginning of play simultaneously with the ante bet. Jackpot bets are not lost if a player decides to fold during the game, but instead are moved to the dealer's area and played on the dealer's hand. If the player's hand, or the dealer's hand if a player has folded, beats or is one of the jackpot hands determined by the casino, the jackpot bet pays off.

It is contemplated that equivalents and substitutions for certain elements set forth above may be obvious to those skilled in the art, and thus the true scope and definition of the invention is to be as set forth in the following claims.

I claim:

1. A method of playing a poker game involving at least one player and a dealer, said method comprising the steps of:

providing a standard 52 card deck of playing cards, a first die having sides with indicia, a second die having sides with indicia, and a plurality of Joker icons;

wherein said first die has at least one side having indicia representative of a Joker and at least one side having indicia representative of a number, with the remaining sides having indicia representative of either a number or a Joker;

wherein each side of said second die has indicia representative of a number;

rolling said first die and second die, dealing to said at least one player the number of cards corresponding to the total of the numbers rolled on said first die and said second die, and further providing a Joker icon said at least one first player if said Joker indicia was rolled;

dealing three cards to said dealer and providing a Joker icon to said dealer;

dealing two additional cards to said at least one player;

dealing two additional cards to said dealer;

determining the best five card poker hand from said cards or from said cards and said Joker icon dealt to said at least one player, wherein said Joker icon is designated to represent any card by said at least one player if possessed by said at least one player;

determining the best five card poker hand from said cards and Joker icon dealt to said dealer; and comparing said best five card poker hand of said at least one player to said best five card poker hand of said dealer to determine the winner.

2. The method of claim 1, further comprising the steps of:

placing an ante bet by said at least one player prior to rolling said first die and second die;

folding or placing a bet by said at least one player after said cards are dealt to said dealer;

staying pat or placing a raise bet by said at least one player after each of said two additional cards are dealt to said at least one player.

3. The method of claim 1, wherein said step of providing said first die having sides with indicia and said second having sides with indicia further comprises providing three sides of said first die with indicia representative of a Joker and three sides of said first die with indicia representative of numbers.

4. The method of claim 3, wherein said step of providing said first die having sides with indicia and said second die having sides with indicia further comprises providing three sides of said first die with indicia representative of a Joker, two sides of said first die with indicia representative of the number two, and one side of said first die with indicia representative of the number one.

5. The method of claim 4, wherein said step of providing said first die having sides with indicia and said second die having sides with indicia further comprises providing three sides of said second die with indicia representative of the number two, two sides of said second die with indicia representative of the number four, and one side of said second die with indicia representative of the number three.

6. The method of claim 2, wherein said step of providing said first die having sides with indicia and said second die having sides with indicia further comprises providing three sides of said first die with indicia representative of a Joker and three sides of said first die with indicia representative of numbers.

7. The method of claim 6, wherein said step of providing said first die having sides with indicia and said second die having sides with indicia further comprises providing three sides of said first die with indicia representative of a Joker, two sides of said first die with indicia representative of the number two, and one side of said first die with indicia representative of the number one.

8. The method of claim 7, wherein said step of providing said first die having sides with indicia and said second die having sides with indicia further comprises providing three sides of said second die with indicia representative of the number two, two sides of said second die with indicia representative of the number four, and one side of said second die with indicia representative of the number three.

9. The method of claim 7, wherein said step of providing two sides of said first die with indicia representative of the number two comprises providing one side of said first die with indicia representative of the number two and providing one side of said first die with indicia representative of the number two and of the option to double said ante bet;

and further comprising the step of maintaining said ante bet or doubling said ante bet by said at least one player if said indicia on said first die representative of the number two and of the option to double said ante bet is rolled.

10. The method of claim 1, wherein in said step of dealing three cards to said dealer, one of said three cards is dealt face up, and further wherein in said step of dealing two additional cards to said at least one player, both of said two additional cards are dealt face up.

11. The method of claim 2, wherein in said step of dealing three cards to said dealer, one of said three cards is dealt face up, and further wherein in said step of dealing two additional cards to said at least one player, both of said two additional cards are dealt face up.

12. A method of playing a poker game involving multiple players and a dealer, said method comprising the steps of:

providing a standard 52 card deck of playing cards, a first die having sides with indicia, a second die having sides with indicia, and a plurality of Joker icons;

wherein said first die has at least one side having indicia representative of a Joker and at least one side having indicia representative of a number, with the remaining sides having indicia representative of either a number or a Joker;

wherein each side of said second die has indicia representative of a number;

placing an ante bet by each of said multiple players;

rolling said first die and second by each of said multiple players in turn, dealing in turn to each of said multiple players the number of cards corresponding to the total of the numbers rolled on said first die and said second die, and further providing a Joker icon to each of said multiple players if said Joker indicia was rolled;

dealing three cards to said dealer and providing a Joker icon to said dealer;

folding or placing a bet by each of said multiple players in turn;

dealing in turn a first card of two additional cards to each of said multiple players remaining and to said dealer;

staying pat or placing raise bet by each of said multiple players remaining;

dealing in turn a second card of two additional cards to each of said multiple players remaining and to said dealer;

staying pat or placing a raise bet by each of said multiple players remaining;

determining the best five card poker hand from said cards or from said cards and said Joker icon dealt to each of said multiple players, wherein said Joker icon is designated to represent any card by each of said multiple players possessing said Joker icon;

determining the best five card poker hand from said cards and Joker icon dealt to said dealer; and comparing said best five card poker hand of each of said multiple players to said best five card poker hand of said dealer to determine the winner.

13. The method of claim 12, wherein said step of providing said first die having sides with indicia and said second die having sides with indicia further comprises providing three sides of said first die with indicia representative of a Joker and three sides of said first die with indicia representative of numbers.

14. The method of claim 13, wherein said step of providing said first die having sides with indicia and said second die having sides with indicia further comprises providing three sides of said first die with indicia representative of a Joker, two sides of said first die with indicia representative of the number two, and one side of said first die with indicia representative of the number one.

15. The method of claim 14, wherein said step of providing said first die having sides with indicia and said second die having sides with indicia further comprises providing three sides of said second die with indicia representative of the number two, two sides of said second die with indicia representative of the number four, and one side of said second die with indicia representative of the number three.

16. The method of claim 14, wherein said step of providing two sides of said first die with indicia representative of the number two comprises providing one side of said first die with indicia representative of the number two and providing one side of said first die with indicia representative of the number two and of the option to double said ante bet;

and further comprising the step of maintaining said ante bet or doubling said ante bet by each of said multiple players if said indicia on said first die representative of the number two and of the option to double said ante bet is rolled.

17. The method of claim 12, wherein in said step of dealing three cards to said dealer, one of said three cards is dealt face up, and further wherein in said step of dealing two additional cards to said at least one player, both of said two additional cards are dealt face up.

18. A method of playing a poker game involving multiple players and a dealer, said method comprising the steps of:

providing a standard 52 card deck of playing cards, a first die having sides with indicia, a second die having sides with indicia, and a plurality of Joker icons;

wherein said first die is provided with three sides of said first die with indicia representative of a Joker, two sides of said first die with indicia representative of the number two, and one side of said first die with indicia representative of the number one;

wherein each side of said second die is provided with three sides of said second die with indicia representative of the number two, two sides of said second die with indicia representative of the number four, and one side of said second die with indicia representative of the number three;

placing an ante bet by each of said multiple players;

rolling said first die said second die by each of said multiple players in turn, dealing in turn to each of said multiple players the number of cards corresponding to the total of the numbers rolled on said first die and said second die, and further providing a Joker icon to each of said multiple players if said Joker indicia was rolled;

dealing three cards to said dealer, one of said three cards being dealt face up, and providing a Joker icon to said dealer;

folding or placing a bet by each of said multiple players in turn;

dealing in turn face up first card of two additional cards to each of said multiple players remaining and to said dealer;

staying pat or placing a raise bet by each of said multiple players remaining;

dealing in turn face up a second card of two additional cards to each of said multiple players remaining and to said dealer, staying pat or placing raise bet by each of said multiple players remaining;

determining the best five card poker hand from said cards or from said cards and said Joker icon dealt to each of said multiple players, wherein said Joker icon is designated to represent any card by each of said multiple players possessing said Joker icon;

determining the best five card poker hand from said cards and Joker icon dealt to said dealer; and comparing said best five card poker hand of each of said multiple players to said best five card poker hand of said dealer to determine the winner.

19. The method of claim 18, wherein said step of providing two sides of said first die with indicia representative of the number two comprises providing one side of said first die with indicia representative of the number two and providing one side of said first die with indicia representative of the number two and of the option to double said ante bet;

and further comprising the step of maintaining said ante bet or doubling said ante bet by each of said multiple players if said indicia on said first die representative of the number two and of the option to double said ante bet is rolled.

* * * * *